United States Patent [19]

Poggi et al.

[11] Patent Number: 5,006,063

[45] Date of Patent: Apr. 9, 1991

[54] CONTINUOUS FURNACE FOR THE HEAT TREATMENT OF ARTICLES, MORE PARTICULARLY CERAMIC PIPES

[76] Inventor: Luigi A. Poggi, Via Oberdan, I-37121 Verona, Italy; Verheyden Jr., Bemmel, P.O. Box 2, NL—6680 Bemmel; Netherland

[21] Appl. No.: 413,471

[22] Filed: Sep. 27, 1989

[30] Foreign Application Priority Data

Sep. 27, 1988 [DE] Fed. Rep. of Germany ..... 3832734

[51] Int. Cl.[5] ..... F27D 3/12

[52] U.S. Cl. ..... 432/121; 432/241; 432/152; 432/124

[58] Field of Search ..... 432/124, 126, 133, 137, 432/141, 144, 152, 153, 154, 162, 241, 254, 253, 121; 34/105

[56] References Cited

U.S. PATENT DOCUMENTS

| | | | |
|---|---|---|---|
| 2,899,189 | 8/1959 | Matis et al. | 432/241 X |
| 3,071,356 | 1/1963 | Duffy | 432/242 X |
| 4,340,361 | 7/1982 | Tanaka et al. | 432/239 X |
| 4,403,954 | 9/1983 | Kokeguchi et al. | 432/124 |
| 4,421,481 | 12/1983 | Holz et al. | 432/241 X |
| 4,505,670 | 3/1985 | Silverstrini et al. | 432/124 |
| 4,628,615 | 12/1986 | Verheyden | 432/124 X |
| 4,718,847 | 1/1988 | Manson | 432/242 X |

FOREIGN PATENT DOCUMENTS

| | | | |
|---|---|---|---|
| 1236688 | 5/1988 | Canada . | |
| 1508506 | 11/1966 | Fed. Rep. of Germany . | |
| 1185972 | 8/1959 | France | 432/152 |
| 367781 | 5/1971 | U.S.S.R. | 432/124 |
| 177561 | 3/1922 | United Kingdom | 432/152 |
| 1473839 | 5/1977 | United Kingdom | 432/124 |

*Primary Examiner*—Herny A. Bennett
*Assistant Examiner*—Christopher B. Kilner
*Attorney, Agent, or Firm*—Howard M. Ellis; Michael L. Dunn

[57] ABSTRACT

The invention relates to a continuous furnace for the heat treatment of articles, more particularly ceramic pipes. The continuous furnace comprises an upper part which is stationary in the conveying direction, can more particularly be raised and lowered and comprises the furnace crown 11, 12, 13, and a lower portion which can move in the conveying direction and comprises at least the furnace bottom. The lower portion is made up of a plurality of carriages 4 which are disposed close one after the other and each bear on an underframe 9 a portion of the furnace bottom 16 and at one end an end face partition 17 subdividing the furnace space into individual chambers. During the heat treatment the articles 24 to be treated remain on the carriage 4, thus eliminating the need for expensive devices for transferring the articles from one conveying means to another conveying means.

9 Claims, 3 Drawing Sheets

Figure 1:
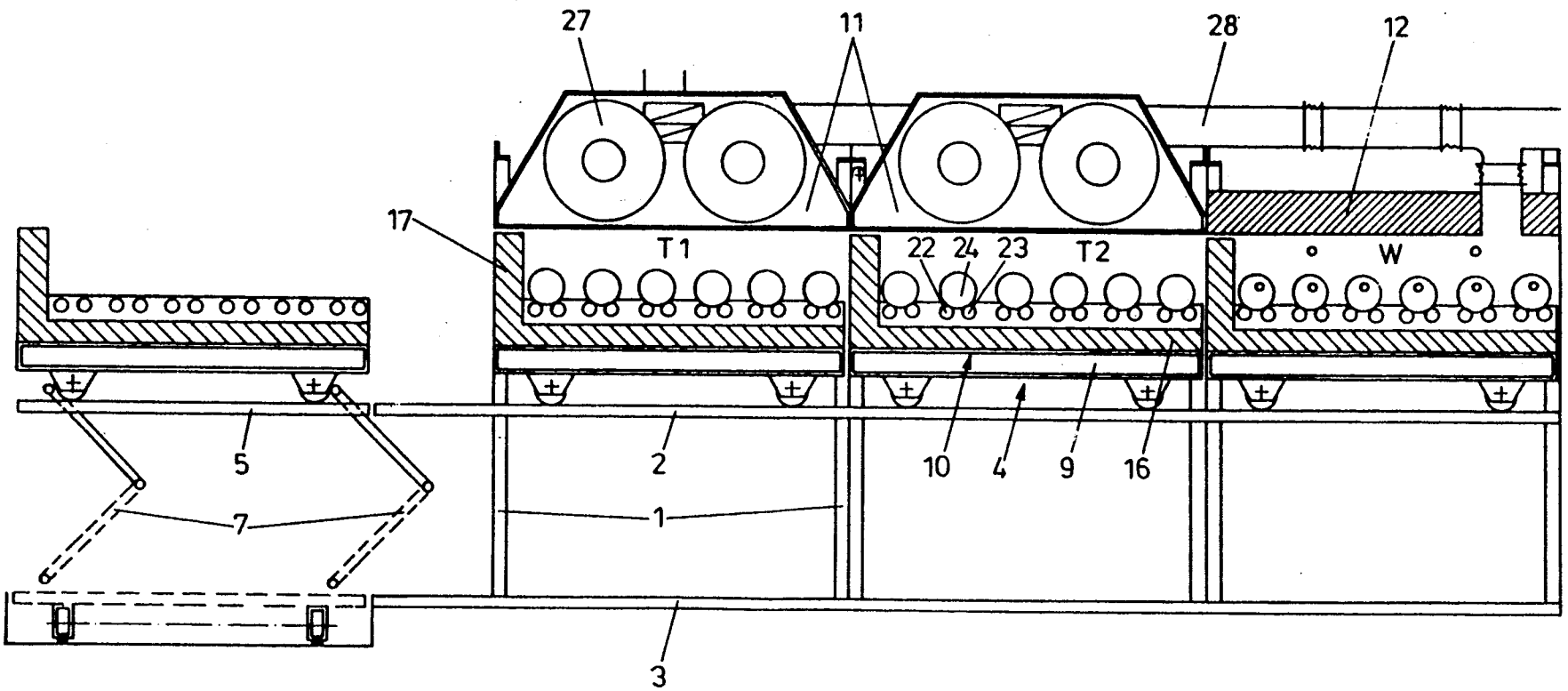

CONTINUOUS FURNACE FOR THE HEAT TREATMENT OF ARTICLES, MORE PARTICULARLY CERAMIC PIPES

The invention relates to a continuous furnace for the heat treatment of articles, more particularly ceramic pipes, having a furnace space subdivided into a number of chambers and conveying means by which the articles can be conveyed through the different chambers.

In continuous furnaces for the heat treatment of articles it is general practice to convey the articles through different temperature zones for their treatment in accordance with a required temperature curve. In the heat treatment of ceramic pipes it has been found that the deformation of the pipes can be prevented only if they rotate around their own axis during the heat treatment in the continuous furnace. This can be achieved by their rolling over a conveying path, but preferably on driven rollers, since in the latter case their own rotation can be independent of the conveying movement. For this reason the pipes can be given the heat treatment while maintaining their own rotation, but with conveying uninterrupted. Use is made of this possibility in a prior art continuous furnace in which the pipes are heated to the maximum heat treatment temperature in a relatively small chamber. The advantage of rapid heating in a small chamber is that, related to the complete continuous furnace, the cost of the parts of the furnace notwithstanding the high temperatures is low. If conveying were not to be interrupted, the heat transport distance with the parts notwithstanding the high temperatures would have to be substantially longer (European Patent 0 131 955 B1). However, one disadvantage of the prior art continuous furnace is that at the inlet and outlet of the chamber for treatment at the maximum temperature devices must be provided for transferring the articles into the chamber from the preceding zone and out of the chamber into the following zone.

It is an object of the invention to provide a continuous furnace of the kind specified in which during their travel through the whole furnace the articles must not be transferred from one conveying means to another conveying means.

To this end, in a continuous furnace of the kind specified, the furnace comprises an upper part which is stationary in the conveying direction and comprises at least the furnace crown or hood and a lower base portion which is movable in the conveying direction, comprises at least the furnace bottom and the partitions between the individual chambers, and has a plurality of carriages disposed close one behind the other and each bearing one of the partitions at its end.

According to the invention the articles to be given the heat treatment remain on the carriages throughout their travel through the furnace. This of course means that the inner parts of each carriage, like the supporting rollers, must be designed for the maximum heat treatment temperatures, but this expenditure is slight in comparison with that required for transferring the articles from one conveying means to another conveying means. The articles are moreover treated more gently, since transference is unnecessary. This is important particularly in the case of thin-walled ceramic pipes. Lastly, due to the partitions on each carriage which travel therewith, there is no need for expensive stationary partitions with locks.

According to one feature of the invention the upper portion and the lower portion each comprise a portion of the side walls. This construction is advantageous more particularly since it facilitates the accommodation of burners and air nozzles on the one hand, and of drives for supporting rollers for the articles to be treated on the other, since according to one feature of the invention the lower portion is equipped with supporting rollers for cylindrical articles to be treated, the supporting rollers extending through the side wall portions and being coupled to drives disposed on the carriage outside the furnace space. The burners and air nozzles can be disposed in the side wall portions of the upper portion.

The upper portion can be raisable, on the one hand to seal the individual chambers satisfactorily against one another and against the outside, and on the other hand to enable the carriages to move slightly. Alternatively, however, the side walls might be made movable, more particularly raisable together with the furnace crown. In that case more particularly squeeze seals can be provided between the parts, such as the wall portions and the furnace cover and end faces, which bear against one another. Sealing by means of sand channels is possible, but does not provide an optimum seal. However, if sand channels are used, there is no need to raise the upper portion to enable the carriages to be moved.

To enable the carriages after passing through the furnace to be conveyed back to the inlet, where they can be unloaded and loaded with fresh articles, according to a further feature of the invention a return track for the carriage extends in the conveying direction below or alongside the furnace, and a transferring device, for example, a lifting platform, moving between the return track and the track of the furnace space, is provided for the carriages.

Figure 2:
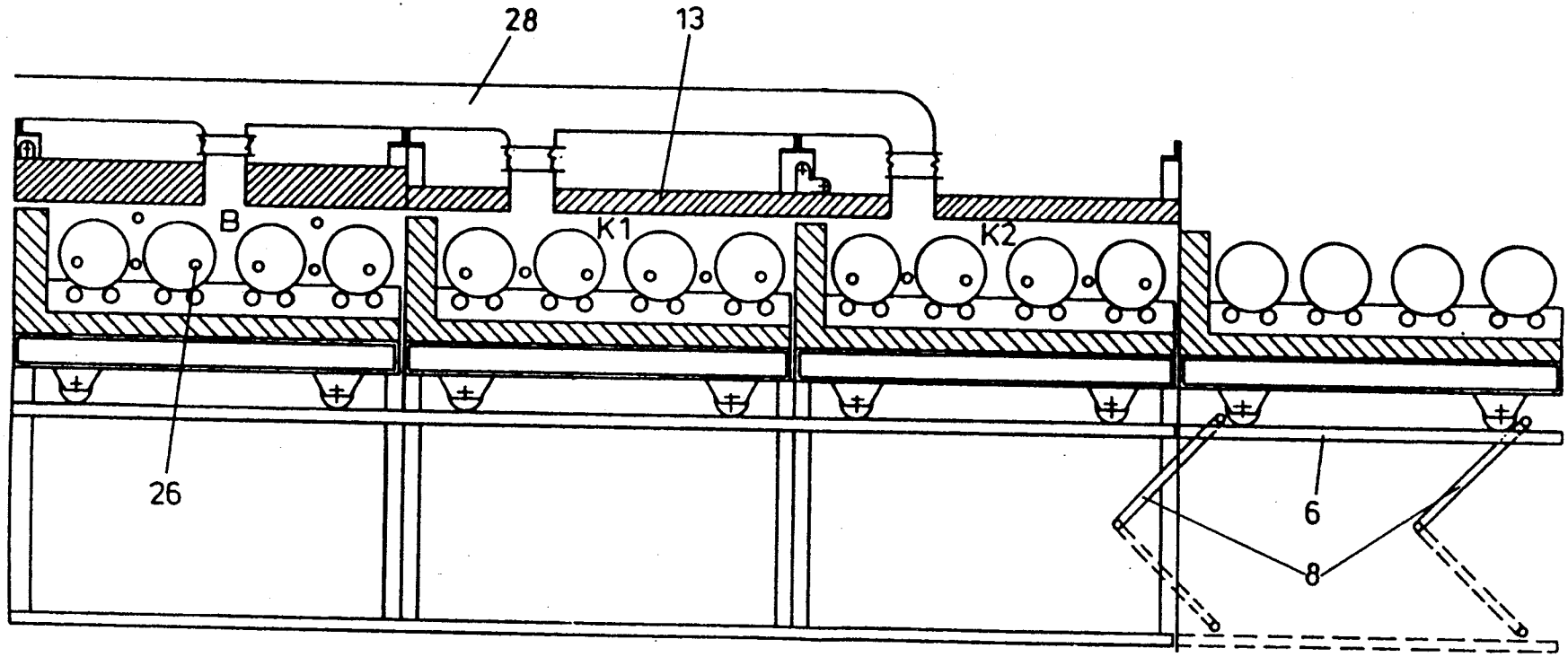
Figure 3:
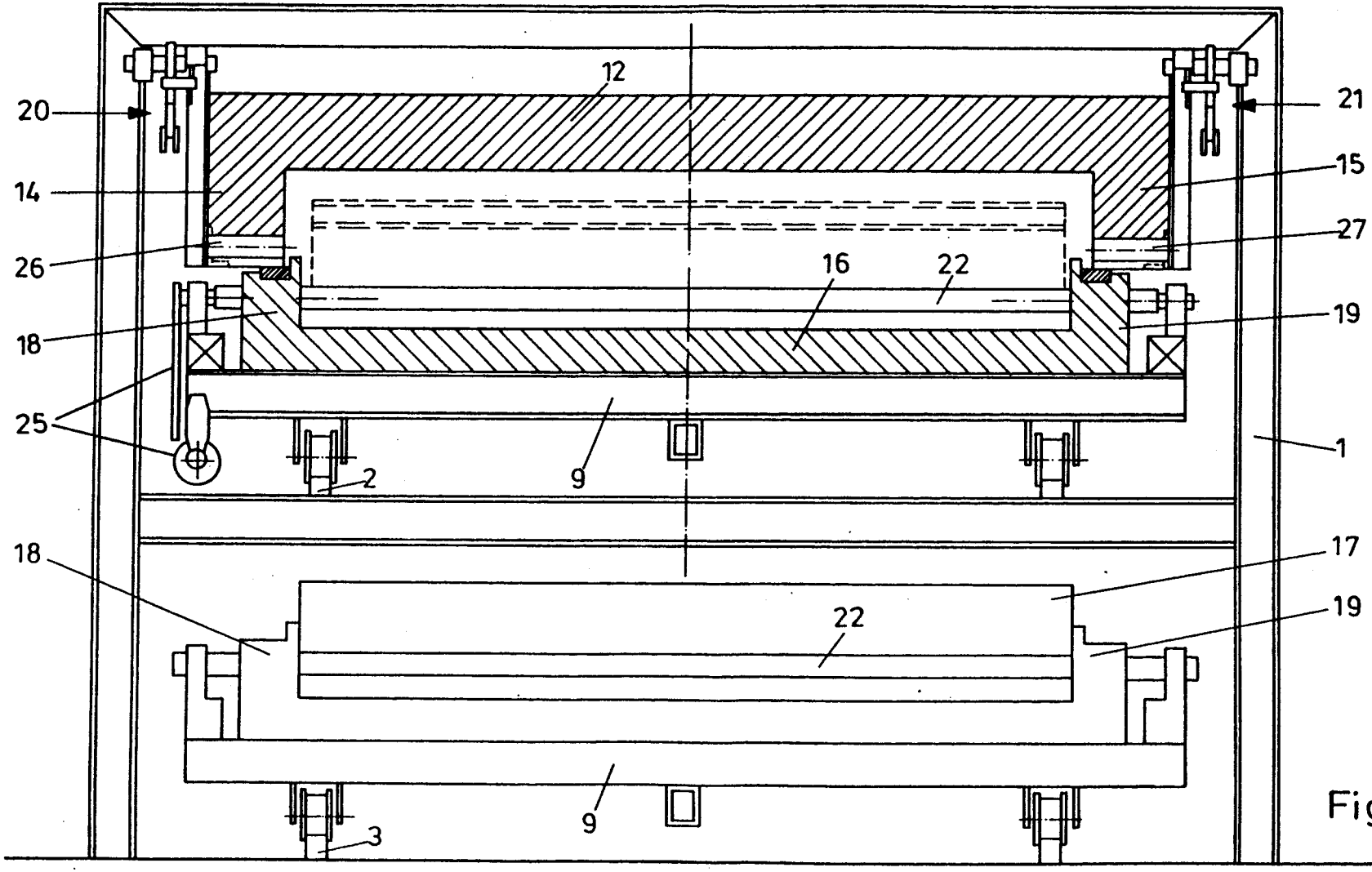

An embodiment of the invention will now be explained in greater detail with reference to the drawings, wherein:

FIG. 1 is a diagrammatic longitudinal section through a continuous furnace with drying chamber and heating chamber, FIG. 2 is a diagrammatic longitudinal section through the continuous furnace shown in FIG. 1, with the firing chamber adjoining the heating chamber, and two cooling chambers, and FIG. 3 is a diagrammatic cross-section through the firing chamber of the continuous furnace shown in FIG. 1.

A continuous furnace has a frame 1 having an upper pair 2 of rails and a pair 3 of rails disposed thereunder and forming tracks for carriages 4. Disposed at the start and end of the pairs 2, 3 of rails are lifting platforms 7, 8 which are equipped with rails 5, 6 and via which the carriages 4 can be transferred from one pair 2 of rails to the other pair 3 of rails.

Each carriage 4 bears a superstructure 10 on an underframe 9. All the carriages 4, disposed close one after the other on the pair 2 of rails, are of identical construction. The carriages 4 are moved in steps over the rails 2 by feed means (not shown). Each last carriage 4 pushes the carriages 4 standing in front.

The continuous furnace is subdivided into an upper portion, comprising a furnace crown 11, 12, 13 and the upper portion of side walls 14, 15, and a lower portion formed by the superstructures 10 of the carriages 4 and comprising in each carriage 4 a bottom 16, a partition 17 disposed at the end, and the lower portions of side walls 18, 19. The upper portion can be lifted off the lower portion by means of lifting devices 20, 21, shown in FIG. 3 for the firing chamber, so that the carriages 4 can be freely moved. Disposed in the lower portion are a number of parallel sets 22, 23 of supporting rollers, each of which bears a ceramic pipe 24 to be treated. The carriages 4 are equipped with more supporting rollers than the carriages 4 shown in FIG. 2, so that smaller, but nevertheless more pipes 24 can be received by such carriages. The supporting rollers 22, 23 extend outwardly through the side walls 18, 19 and are coupled to drives 25 which can consist of electric motors, transmissions and chains. The motors can be supplied with current from collectors sliding on fixed contact rails. Distributed in the side walls 14, 15 of the upper portion are openings 26, 27 in which burners and ventilating nozzles can be disposed.

By the partitions 17 borne by the carriages 4 the furnace space is subdivided into a number of successive chambers namely, in the conveying direction, two drying chambers $T_1$, $T_2$, a heating chamber W, a combustion chamber B and two cooling chambers $K_1$, $K_2$. The chamber spaces of the heating chamber W, the combustion chamber B and the cooling chambers $K_1$, $K_2$ are connected via a pipe 28 to the drying chambers $T_1$, $T_2$, so that the hot exhaust air from the heating chamber W and the combustion chamber B, as well as the air heated during cooling in the cooling chambers $K_1$, $K_2$, can be guided into the drying chambers $T_1$, $T_2$ and used to dry the pipes. Circulating fans 27 are installed in the furnace crown to improve the circulation of the atmosphere in the drying chambers $T_1$, $T_2$.

In the continuous furnace according to the invention articles, more particularly ceramic pipes, can be given a heat treatment in accordance with a required temperature curve with interruption of conveying, but continuation of their own rotation. No transference from one conveying means to another conveying means is required throughout their travel through the continuous furnace. Since only the supporting rollers for the articles to be given the heat treatment are disposed inside the furnace space, while all other mechanical parts, such as drives, are disposed outside the furnace space, the cost incurred for highly heat-resistant parts can be kept within limits.

We claim:

1. A furnace for heat treatment of articles, which comprises a plurality of connected zones for heating and cooling of said articles, each zone comprising an upper hood section which comprises a top wall and opposing side walls extending downwardly from said top wall; a train of lower base sections movable through said furnace relative to said upper hood sections, said lower base sections each comprising carriage means for transporting said articles through each of said furnace zones, said carriage means comprising a bottom wall, opposing side walls extending upwardly from said bottom wall, partition means disposed at an end of said lower base section and roller means adapted for supporting cylindrically shaped articles, said lower base sections adapted to coincide with said upper hood sections to provide individual furnace chambers for said zones wherein said downwardly extending, opposing side walls of said upper hood section and said upwardly extending side walls of said lower base section together form the side walls of said chambers.

2. The furnace of claim 1 wherein said roller means is mounted through said opposing side walls.

3. The furnace of claim 2 including drive means for turning said roller means.

4. The furnace of claim 3 wherein said drive means for turning said roller means are located outside said furnace chambers.

5. The furnace of claim 2 including means for raising and lowering said upper hood section.

6. The furnace of claim 1 wherein said upper hood section is stationary in the conveying direction.

7. The furnace of claim 1 including a furnace inlet and furnace outlet and track means for returning said carriage means from said furnace outlet to said furnace inlet.

8. The furnace of claim 7 wherein said track means for returning said carriage means to said furnace inlet extends below said furnace.

9. The furnace of claim 7 wherein said track means for returning said carriage means to said furnace inlet extends alongside said furnace.

* * * * *